United States Patent [19]

Sakamoto et al.

[11] 3,956,661

[45] May 11, 1976

[54] D.C. POWER SOURCE WITH TEMPERATURE COMPENSATION

[75] Inventors: Jyunji Sakamoto; Norio Imaizumi; Eisuke Shiratani, all of Gunma, Japan

[73] Assignees: Tokyo Sanyo Electric Co., Ltd., Osaka, both of; Sanyo Electric Co., Ltd., Osaka, Japan

[22] Filed: Nov. 6, 1974

[21] Appl. No.: 521,544

[30] Foreign Application Priority Data

Nov. 20, 1973 Japan ..... 48-135311[U]
Apr. 3, 1974 Japan ..... 49-38423[U]

[52] U.S. Cl. ..... 307/297; 323/4; 323/9; 323/22 T

[51] Int. Cl.[2] ..... G05F 1/58

[58] Field of Search ..... 307/296, 297; 323/1, 323/4, 9, 22 T

[56] References Cited

UNITED STATES PATENTS 3,430,076 2/1969 Overtveld ..... 307/297
3,483,464 12/1969 Embree et al. ..... 307/297 X
3,781,648 12/1973 Owens ..... 323/4

OTHER PUBLICATIONS

*Limitador Electronico de Corriente*, Article in "Revista Telegrafica Electronica" Oct. 1971.

*Primary Examiner*—Alfred E. Smith
*Assistant Examiner*—E. R. La Roche
*Attorney, Agent, or Firm*—Armstrong, Nikaido & Wegner

[57] ABSTRACT

An improved D. C. power source whose output voltage is independent of changes in temperature is disclosed. Compensation for changes in temperature is established by three features. For a change of the voltage drop in the forward direction between the base and the emitter of a transistor, a plurality of diodes provided in a bias circuit in the transistor are utilizied; for a change of the current amplification factor $\beta$ of a transistor, an additional transistor is attached to the transistor, and; for a change of the value of an emitter resistor connected between the emitter of the transistor and the ground, an external stable resistor is utilized. The D. C. power source of the present invention is, in particular, useful for an integrated circuit.

4 Claims, 8 Drawing Figures

D.C. POWER SOURCE WITH TEMPERATURE COMPENSATION

BACKGROUND OF THE INVENTION

The present invention relates to an improved D.C. power source for stabilizing an output voltage and/or current especially in integrated circuits (IC) and also for compensating for deviation or fluctuation in the current amplification factor $h_{FE}$ or $\beta$ of a transistor due to variation in the ambient temperature.

Heretofore, in a transistor circuit for supplying constant output voltage, a power supply voltage was divided by a pair of bias resistors including an emitter resistor in a transistor circuit built in an integrated circuit block, and the divided voltage was supplied to a transistor or transistors also built in the integrated circuit blocks. However, in a prior D.C. power source the compensation for preventing the change of the output voltage due to temperature change was not enough because the values of the resistances in the IC blocks were considerably varied by discrepancies among resistors as well as temperature variations, and it was very difficult to construct a transistor circuit in which an absolute value of the current flowing through a load was maintained constant.

SUMMARY OF THE INVENTION

A main purpose of the present invention is, therefore, to provide a D.C. power source having a temperature compensation circuit in which variation in the voltage drop between the base and emitter of a transistor due to variation in the ambient temperature is compensated.

Another purpose of the present invention is to provide a D.C. power source having a temperature compensation circuit in which variation or deviation of the current amplification factor $h_{FE}$ or $\beta$ due to variation in the ambient temperature is compensated.

A still further purpose of the present invention is to provide a D.C. power source having a temperature compensation circuit in which the effect of variation in the ambient temperature on the output voltage and/or current compensated.

According to the features of the present invention, the change of the voltage drop between the base and the emitter of a trasnsistor due to temperature change is compensated for by using some diodes in the bias circuit of the transistor; the change of the current amplification factor $h_{FE}$ or $\beta$ of a transistor due to temperature change is compensated for by using an additional transistor, and; the change of the characteristics of a circuit due to the change of a value of a resistance because of temperature change is compensated for by using an external stable resistor.

BRIEF DESCRIPTION OF THE DRAWINGS

Other purposes and advantages of this invention will be better understood from the following explanation with reference to the attached drawings in which.

PREFERRED EMBODIMENTS OF THE INVENTION

Figure 1:
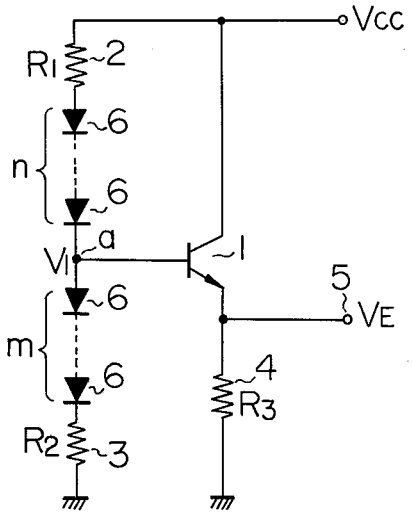
FIG. 1 illustrates a temperature compensation circuit disclosed by the inventors in which the variation of a voltage drop $V_{BE}$ between the base and emitter due to temperature change is compensated.

FIG. 1 shows the first embodiment of the present invention. The circuit comprises a transistor 1, the resistors 2, 3, 4 (R1, R2, R3)and $n$ number of diodes 6. The $N$ number of diodes 6, connected in series with the resistor R1, are connected between the base and the collector of the transistor 1. Similarly, $m$ number of the diodes 6, connected in series with the resistor R2, are connected between the base of the transistor 1 and ground. The numbers of the diodes $m$ and $n$ are determined in accordance with a relationship between the output voltage or the emitter voltage $V_E$, and the source voltage Vcc.

In the circuit in FIG. 1, the voltage $V_1$ appearing at the junction point (a) is expressed by the following equation.

$$V_1 = \frac{Vcc-(n+m)V_f}{R_1+R_2}R_2 + m\cdot V_f$$

$$= \frac{Vcc-(n+m)V_f}{1+\frac{R_1}{R_2}} + m\cdot V_f$$

$$V_E = V_1 - V_f$$

$$= \frac{Vcc-(n+m)V_f}{1+\frac{R_1}{R_2}} + (m-1)V_f$$

$$= \frac{Vcc}{1+\frac{R_1}{R_2}} + \frac{\frac{R_1}{R_2}(m-1)-n-1}{1+\frac{R_1}{R_2}}V_f$$

where $Vcc$ is the voltage of the power supply, $R1$ and $R2$ are the resistors dividing the voltage of the power supply $Vcc$, $V_f$ is the voltage drop in the forward direction of each diode 6 which is considered to be the same as the voltage drop $V_{BE}$ appearing between the base and emitter of the transistor 1. In the above equations, in order that the voltage $V_E$ be independant from the variation of $V_f$, coefficient of the second term of $V_f$ must be zero, which would result in the following equation.

$$\frac{R1}{R2}(m-1)-n-1 = 0 \qquad (1)$$

When the equation (1) above is established, the equation for the output voltage $V_E$ becomes:

$$V_E = \frac{Vcc}{1 + \frac{R_1}{R_2}} \quad (2)$$

Figure 2:
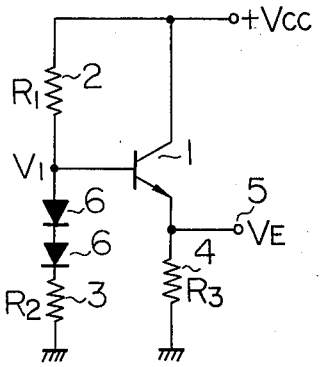
FIG. 2 illustrates an example in accordance with the circuit of FIG. 1, where the number of the diodes are $m=2$, $n=0$.
Figure 3:
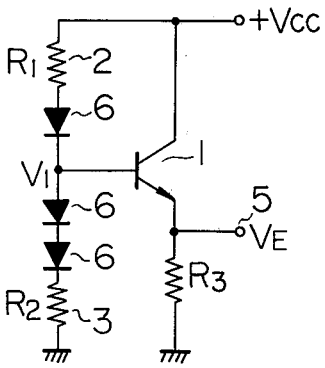
FIG. 3 illustrates an another example in accordance with the circuit of FIG. 1, where the number of the diodes are $m=2$, $n=1$.

In order to decide the number of the diodes $m$ and $n$, the following calculation is established. For example, when it is desired to obtain an output voltage of $V_E = Vcc/2$, the respective number of diodes $m=2$, and $n=0$ are decided upon using the relationship R1/R2 = 1 and the above equations (1) and (2). In this case, the circuit construction is as shown in FIG. 2. Likewise, when it is desired to obtain an output voltage of $V_E = Vcc/3$, the number of diodes becomes $m=2$ and $n=1$ using the relationship R1/R2=2. The circuit construction in this case is as shown in FIG. 3. As described above, whenever the dividing ratio of the D.C. power supply voltage $Vcc$ is desired, the first and second resistors R1 and R2 and values of $m$ and $n$ are in turn determined. Thus the effect of the change of the voltage drop between the base and emitter $V_{BE}$ of the transistor 1 due to temperature change is completely avoided by inserting a predetermined number of diodes 6. This is especially effective for the temperature compensation circuit with an emitter follower circit using an IC.

In order to compensate for the variation in the load current due to the variation in the ambient temperature, it is not enough to compensate for only the change of voltage drop $V_{BE}$ between the base and emitter. That is, the variation in the current amplification factor $\beta$ of the transistor must also be compensated.

Figure 4:
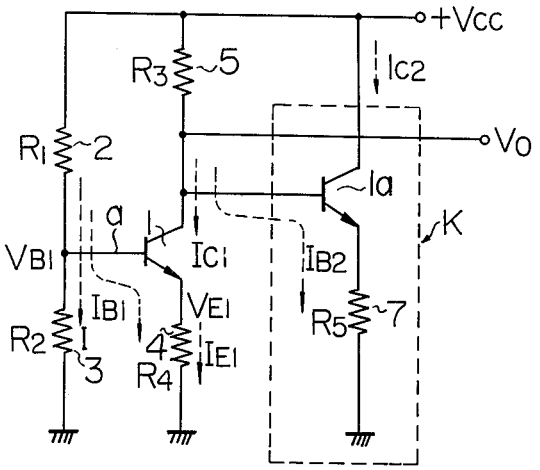
FIG. 4 illustrates an embodiment of a bias circuit having another temperature compensation circuit according to the present invention in which variations in the current amplification factor $\beta$ are compensated.

FIG. 4 shows a bias circuit having means for compensating for the fluctuation in the current amplification coefficient $\beta$ due to the variation in the ambient temperature in a D.C. power source. In FIg. 4, when no compensating means K outlined by the dotted line is provided, the current amplification coefficient $h_{FE}$ or $\beta$ of the transistor 1 is increased as the ambient temperature increases. As a result, the base current $I_{B1}$ of the transistor 1 is decreased and the base potential $V_{B1}$ of the transistor 1 is slightly increased, thus increasing the emitter potential $V_{E1}$ and also increasing the emitter current $I_{E1}$ as well as the collector current $I_{C1}$. Moreover, the increase of the coefficient $h_{FE}$ or $\beta$ causes the collector current $I_{C1}$ to be increased by the amount that the base current $I_{B1}$ is decreased. Accordingly, the increase of the amplification factor $h_{FE}$ or $\beta$ increases the current $I_{C1}$ due to bias fluctuation as well as causing the decrease of the current $I_{B1}$ and this, in turn, causes the collector voltage Vo of the transistor 1 to be decreased. This situation is shown as the curve D in FIG. 5.

Returning now to FIG. 4, the circuit is provided with the circuit K which comprises the transistor I*a* and the resistor 7 (R5). The function of the circuit K according to the present invention is as follows. If the emitter current $I_{E1}$ of the transistor 1, which flows through the resistor R4, is expressed by OHm's law, that is, $I_{E1} = V_{E1}/R_4$, then the base current of the transistor 1 becomes:

$$IB_1 = \frac{I_{E1}}{1+\beta} = \frac{V_{E1}}{(1+\beta)R_4}$$

$$= \frac{Vcc}{(1+\beta)\left(1 + \frac{R_1}{R_2}\right) R_4}$$

and the following equation can be established.

$R_1(I+I_{B1})+IR_2 = Vcc$, where, the voltage drop $V_{BE}$ between the base-emitter of each transistor is $V_{BE}=0$, and the voltage $V_{B1}$ appearing at the junction point ($a$) becomes equal to the voltage $V_{E1}$ appearing across the resistor R4, that is, $V_{B1} = V_{E1}$. Accordingly, the current flowing from the resistor R1 to the resistor R2 becomes $$I = \frac{Vcc - I_{B1}R_1}{R_1 + R_2}$$

and the following equation is established.

$$V_{B1} = V_{E1} = IR_2$$

$$= \frac{Vcc - I_{B1} R_1}{R_1 + R_2} R_2$$

$$\frac{Vcc}{1 + \frac{R_1}{R_2}} - \frac{R_1 \cdot V_{cc}}{R_4(1+\beta)\left(1+\frac{R_1}{R_2}\right)}$$

wherein, the collector current $I_{C1}$ of the transistor 1 can be expressed by the following equation;

$$I_{C1} = \frac{I_{E1}}{1+\frac{1}{\beta}}$$

$$= \frac{1}{1+\frac{1}{\beta}} \cdot \frac{V_{E1}}{R_4}$$

$$= \frac{1}{1+\frac{1}{\beta}} \cdot \frac{Vcc}{R_4} \left\{ \frac{1}{1+\frac{R_1}{R_2}} - \frac{1}{(1+\beta)(1+\frac{R_1}{R_2})2} \cdot \frac{R_1}{R_4} \right\} \quad (3)$$

$$V_o = Vcc - (I_{C1} + I_{B2})R_3 \quad (4)$$

$$I_{B2} \cong \frac{Vcc - I_{C1} \cdot R_3}{1+\beta} \cdot \frac{1}{R_5} \quad (5)$$

Substituting the equations (3) and (5) for the equation (4), the output voltage $V_o$ becomes;

$$V_o = Vcc - \frac{R_3}{R_4} \cdot \frac{Vcc}{1+\frac{1}{\beta}} \cdot \frac{1}{1+\frac{R_1}{R_2}} \left\{ 1 - \frac{1}{(1+\beta)(1+\frac{R_1}{R_2})} \cdot \frac{R_1}{R_4} \right\} x \left(1 - \frac{R_3}{R_5} \cdot \frac{1}{1+\beta}\right) - \frac{R_3}{R_5} \cdot \frac{Vcc}{1+\beta} \quad (6)$$

From the equation (6), the output voltage $V_o$ is a function of both the resistance ratio of each resistor and the current amplification factor $\beta$ of the transistor. In the case of an IC circuit, each resistor ratio can be accurately controlled by a production scheme so that the selection of the optimum value for each resistor ratio will decrease the influence of the change of the current amplification factor $\beta$ and, thereby, the effect of the fluctuation of the factor $\beta$ due to the variation in the temperature is avoided and the output voltage Vo is controlled so that it is constant.

Figure 5:
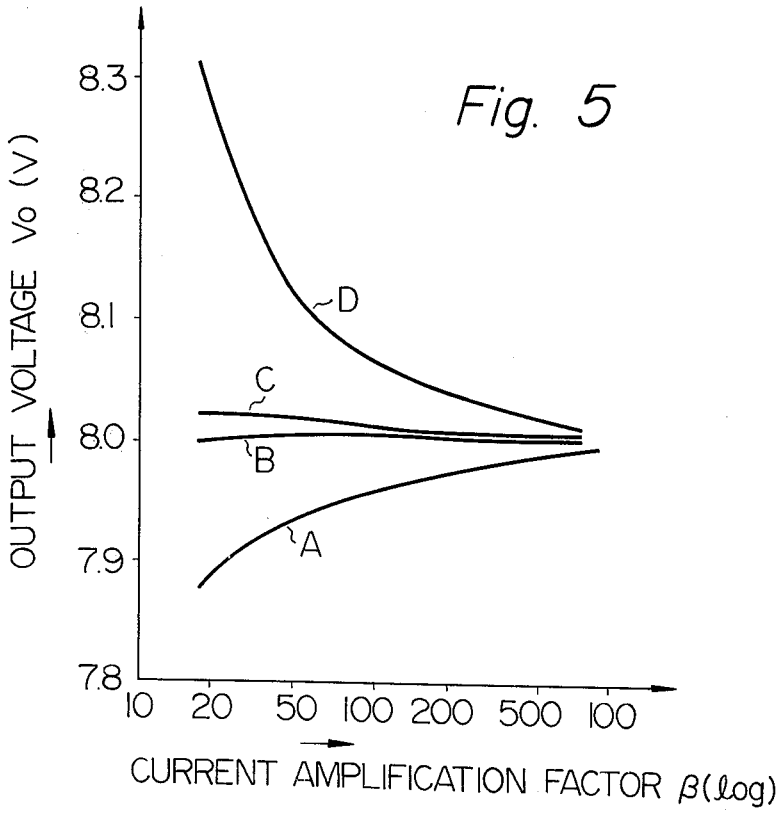
FIG. 5 illustrates characteristic curves of the circuit of FIG. 4 in which the value of a resistor is a parameter.

FIG. 5 shows characteristic curves of the circuit of FIG. 4 according to the present invention. In this case, the values of the resistor elements are R1=10Ω, R2=R3=R4=5kΩ and the value of the resistor R5 is a parameter. In FIG. 5, curve A shows the case where the resistor R5=4.7 kΩ, curve B where R5 = 6.4 kΩ, and curve C where R5=8.2 kΩ, respectively. Curve D shows the case where there is no compensation circuit K according to the present invention. As is apparent from FIG. 5, the selection of the resistor R5 as 6.4K enable the output voltage $V_O$ to be maintained constant regardless of the value of the factor $\beta$. The constant or flat characteristic curve as shown in curve B or C in FIG. 5 can be attained by the resistor ratio of R1/R2, R3/R4, R1/R4 and R3/R5 in the circuit of FIG. 4 and therefore, the present invention is extremely useful for IC circuits. In fact, when the circuit according to the present invention is used in a pulse oscillator in a temperature variation from 10°C to 60°C, a favorable result of frequency drift of less than 1% has been obtained.

Figure 6:
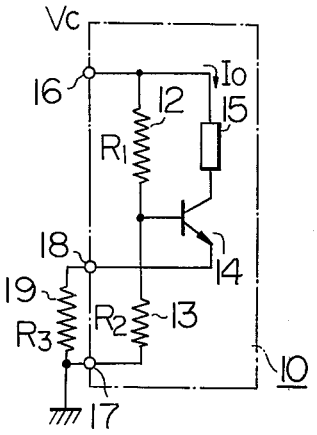
FIG. 6 illustrates another circuit of an improved D.C. power supply according to the present invention.

FIG. 6 shows another embodiment of the present invention. In FIG. 6, the integrated circuit comprises resistors R1 and R2, transistor 14, and load 15, an the external registor R3 is provided outside the integrated circuit. A power supply is applied to the terminal 16. In this circuit, when the voltage drop $V_{BE}$ between the base and the emitter of the transistor 14 is negligibly small and the current amplification coefficient $h_{FE}$ is sufficiently large, the emitter voltage $V_E$ of the transistor 14 is:

$$V_E = \frac{R_2}{R_1 + R_2} V_c = \frac{V_c}{1 + \frac{R_1}{R_2}}$$

Therefore, the load current Io becomes:

$$Io = \frac{V_E}{R_3} = \frac{V_C}{R_3} \cdot \frac{1}{1 + \frac{R_1}{R_2}}$$

In this case, even if the resistors 12 (R1) and 13 (R2) of the integrated circuit (IC) have discrepancies in quality, the combination of the resistors 12 (R1) and 13 (R2) presents an extremely stable characteristic as explained above, so that the current Io is maintained at a constant value determined by the power supply voltage *V*cc and the resistance R3 of the emitter resistor 19.

However, in the circuit construction in FIG. 6, when the output voltage $V_E$ is excesssively lowered, the discrepancy of the resistance ratio of 12 (R1) and 13 (R2) can not be neglected, thus losing the stability of the current Io. As a result, in the circuit with a supply voltage $V_C$ more than a few volts, the collector potential comes close to the base potential, and the transistor saturates. This is not a good condition.

Figure 7:
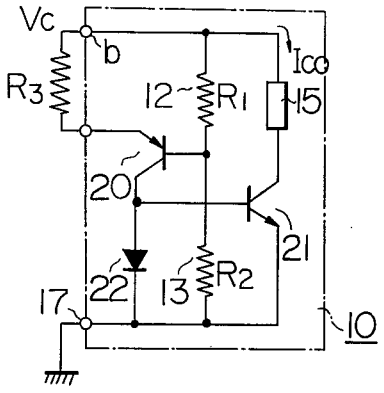
FIG. 7 illustrates one modification of FIG. 6.

FIG. 7 shows another embodiment according to the present invention which comprises a first trnasistor 20, and a second transistor 21. The bias is applied to the first transistor 20 through the bleeder resistors 12 and 13, and the second transistor 21 is biased by the voltage appearing across the diode 22. The load current Io is supplied to the load 15. According to the circuit constructions of FIG. 7, even when the base bias of the first transistor 20 is chosen to be a few volts which enables the error of the resistnace ratio of R1/R2 to be negligibly small the voltage drop at the diode 22 which is applied to the collector of the first transistor 20 is about 0.7 volt, so that the first transistor 20 does not saturate. Also, the base bias of the transistor 21 does not saturate as the transistor 21 is biased through the diode 22, and thus operates in the active operational region of a transistor, and the transistor 21 cause a current to flow in the load 15, the value of which current is the same as the collector current of the first transistor 20.

In the above example, an explanation has been presented of the case where the forward voltage drop $V_{BE}$ between the base and emitter of the transistors is zero and the current amplification coefficient $h_{FE}$ or $\beta$ is sufficiently large. However, the aobve two assumptions can not be satisfied practically.

Figure 8:
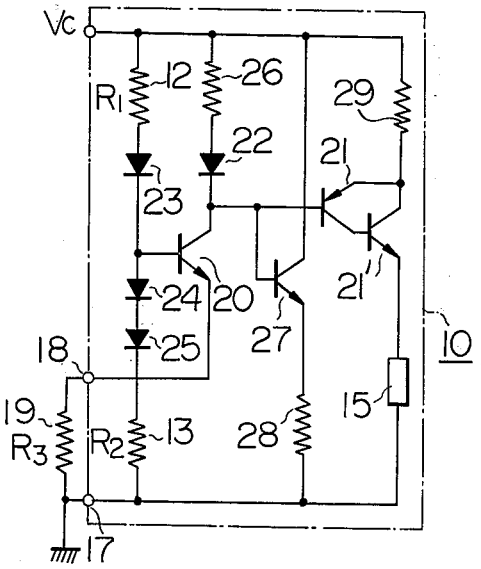
FIG. 8 illustrates another modification of FIG. 6 in which the temperature compensating circuit of FIG. 1 and the bias circuit of FIG. 4 are incorporated with the cirucit of FIG. 6 in order to compensate for fluctuation due to variations in temperature.

FIG. 8 shows an another embodiment of the D.C. power supply circuit according to the present invention. In order to prevent the error due to the above assumptions, the base of the first transistor 20 is biased through the bias resistors 12 and 13 and the diodes 23, 24, and 25 in such a way that the the emitter voltage at the terminal 18 becomes $V_E = V_{CC}/3$ with the resistor ratio of $R_1/R_2$ being equal to 2. The circuit in FIG. 8 includes all features of the circuits in FIGS. 1, 4 and 6.

In the embodiment of the circuit of FIG. 8, the ratio of resistors is R1/R2=2 and the number of diodes *m* and *n* is *m*=2 and *n*=1 in order to obtain the emitter voltage $V_E = V$cc/3. The transistor 27 and the resistor 28 in the figure correspond to the transistor 1*a* and the resistor 7 (R5) in the circuit K of FIG. 4 respectively. With this condition, the voltage $V_{BE}$ of each transistor and the forward voltage drop $V_f$ of each diode are all supposed to be equal in the case of the IC circuit, so that the outut voltage does not depend on the variation in $V_{BE}$ or $V_f$.

Now, an increase of the current amplification coefficient $h_{FE}$, as a result of an increase of temperature, causes the collector current to become large due to the decrease of the base current of the first transistor 20 and also causes the collector potential to be decreased. On the other hand, an increase of the coefficient $h_{FE}$ of the auxiliary transistor 27 causes the base current of the transistor to be decreased and this, in turn, causes the collector potential of the first transistor 20 to be increased. Accordingly, proper selection of the emitter resistor 28 of the auxiliary transistor 28 will cause the collector potential of the first transistor 27 to be constant regardless of the variation in the current amplification factor $H_{EE}$. In this case, since the transistors 21 and 21 connected to the transistor 20 and 27 constitute a so-called Darlington circuit connection, the base current thereof may be sufficiently small.

In the above case, the assumption is made that the value of resistance does not depend upon temperature change, but actually, variation of the value of resistance occurs in the monolithic IC circuit. Therefore, the collector potential of the transistor 20 is varied in proportion to the variation in the value of the resistor 26. However, since the variation in resistor 29 is also the same as that of the resistor 26, the collector current of the transistor 21 can be maintained constant.

From the foregoing, it will be apparent that the provision of at least a pair of transistors with one of the transistors being supplied the base bias by dividing the power supply voltage, as well as the provision of a load in the other transistor and the emitter resistor connected to the external terminal, the current flowing through the load can be maintained constant regardless the variation in temperature. Accordingly, in such a case as a monolithic IC circuit in which the fluctuation of the load current in the IC circuit is large, the circuit shown in FIG. 8 will be particularly useful.

As is apparent from the foregoing description, the present invention is not limited to the embodiments specifically described in this specification, but various variation and modifications are possible without departing from the spirit and the scope of the invention.

What is claimed is:

1. An improved D.C. power source comprising a transistor, the collector of which is connected to a power source of Vcc volt and the emitter of which is connected to ground, a first series circuit having a first resistor with a resistance $R_1$ and n number diodes connected between the power source and the base of said transistor, a second series circuit having a second resistor with a resistance $R_2$ and m number of diodes connected between the base of said transistor and ground, an output terminal connected to the emitter of said transistor for providing stabilized voltage of $V_E$ volt, and values of *m* and *n* satisfying the following equations:

$$\frac{R_1}{R_2}(m-1) = n+1$$

$$V_E = \frac{Vcc}{1+\frac{R_1}{R_2}}.$$

2. An improved D.C. power source comprising a first transistor, the collector of which is connected to a power source through a first resistor and the emitter of which is connected to ground through a second resistor, a dividing circuit having a plurality of resistors connected between the power source and ground, a junction point of said dividing circuit being connected to the base of said first transistor, a second transistor the collector of which is connected to the power source the base of which is connected to the collector of said first transistor and the emitter of which is connected to ground through a third resistor, and an output terminal connected to the collector of said first transistor, whereby a value of output voltage on said output terminal is stabilized regardless the change of the current amplification factor ($h_{FE}$) of the transistors due to the ambient temperature change.

3. An improved D.C. power source comprising an integrated circuit having at least a first and a second transistor, the emitter of the first transistor being connected to an external terminal, an external resistor connected between said external terminal and a power source, said integrated circuit further comprising a diode connected between the collector of the first transistor and ground, a dividing circuit having a pair of resistors connected between the power source and ground, the junction of the resistors of said dividing circuit being connected to the base of said first transistor, a load connected between the power source and the collector of said second transistor, and the base and emitter of the second transistor being connected in parallel with said diode.

4. An improved D.C. power source comprising an integrated circuit having at least an external terminal, and an external resistor connected between said external terminal and ground, said integrated circuit further comprising a first and a second transistor, the emitter of the first transistor being connected to said external terminal and the emitter of the second transistor being connected to ground through a resistor, a first series circuit having at least a resistor and a diode connected between the power source and the base of the first transistor, a second series circuit having at least a resistor and a diode connected between the base of the first transistor and ground, a third series circuit having at least a resistor and a diode connected between the power source and the collector of the first transistor, the collector of the second transistor being connected to the power source, and the base of the second transistor being connected to the collector of the first transistor and a terminal of one side of a load.

* * * * *